US006192640B1

(12) United States Patent
Snyder

(10) Patent No.: US 6,192,640 B1
(45) Date of Patent: Feb. 27, 2001

(54) DOUBLE DIVISIBLE CONNECTOR FRAME FOR MOUNTING AIR GRILLES AND LOUVERS TO HEATING AND COOLING DUCT OUTLETS

(76) Inventor: Darryl L. Snyder, 4520 N. Market Ave., Canton, OH (US) 44714

( * ) Notice: Subject to any disclaimer, the term of this patent is extended or adjusted under 35 U.S.C. 154(b) by 0 days.

(21) Appl. No.: 09/146,671

(22) Filed: Sep. 3, 1998

Related U.S. Application Data

(63) Continuation of application No. 09/766,061, filed on Dec. 16, 1996, now abandoned.

(51) Int. Cl.[7] ..... F24F 13/08; F24F 7/00; E04F 17/04

(52) U.S. Cl. ..... 52/302.1; 52/98; 52/198; 52/302.7; 52/473; 52/507; 52/656.8; 454/270; 454/271; 454/275; 454/277; 454/331; 220/3.5

(58) Field of Search ..... 52/98, 204.61, 52/302.1, 473, 507, 510, 656.1, 656.2, 656.8, 302.3, 302.7, 198; 454/270, 271, 275, 276, 277, 280, 330, 331, 367, 284, 358; 285/64; 248/27.1, 906; 220/3.3, 3.4, 3.5, 3.6, 3.8, 3.9, 3.92, 3.94

(56) References Cited

U.S. PATENT DOCUMENTS

| | | | | |
|---|---|---|---|---|
| 574,475 | * | 1/1897 | Cooper | 454/261 |
| 1,438,982 | * | 12/1922 | Christensen | 52/507 |
| 1,790,031 | * | 1/1931 | Vaughn | 248/906 X |
| 1,979,543 | * | 11/1934 | Heasley | 52/656.8 X |
| 2,005,226 | * | 6/1935 | Dwyer | 454/306 X |
| 2,439,091 | * | 4/1948 | Keating | 248/27.1 |
| 2,611,310 | * | 9/1952 | Cowan | 52/302.1 X |
| 2,661,677 | * | 12/1953 | Lingelbach | 454/331 |
| 2,717,715 | * | 9/1955 | Whelan | 220/3.94 |
| 2,939,377 | * | 6/1960 | Stach | 454/332 |
| 3,220,079 | * | 11/1965 | Aggson | 52/302.3 |
| 3,724,135 | * | 4/1973 | Heliotes | 52/213 X |
| 3,740,934 | * | 6/1973 | Shuler | 454/284 X |
| 3,769,769 | * | 11/1973 | Kohl | 52/212 |
| 4,026,082 | * | 5/1977 | Crofoot | 454/276 X |
| 4,569,458 | * | 2/1986 | Horsley | 220/3.6 |
| 4,673,097 | * | 6/1987 | Schuldt | 220/3.5 |
| 4,778,134 | * | 10/1988 | Struthers et al. | 248/906 X |
| 4,794,207 | * | 12/1988 | Norberg et al. | 220/3.3 X |
| 4,927,039 | * | 5/1990 | McNab | 220/3.7 |
| 4,986,499 | * | 1/1991 | Ponticelli | 248/909 X |
| 5,014,610 | * | 5/1991 | Twito | 454/330 X |
| 5,287,665 | * | 2/1994 | Rath, Jr. | 220/3.3 X |
| 5,295,644 | * | 3/1994 | Ferguson, Jr. | 248/27.1 |
| 5,326,060 | * | 7/1994 | Chubb et al. | 248/906 X |
| 5,444,947 | * | 8/1995 | Miller | 454/271 X |
| 5,448,011 | * | 9/1995 | Laughlin | 174/48 |
| 5,468,538 | * | 11/1995 | Nameche | 52/202 X |
| 5,478,031 | * | 12/1995 | Miller | 248/27.1 |
| 5,615,850 | * | 4/1997 | Cloninger | 248/909 X |

FOREIGN PATENT DOCUMENTS

| | | | | |
|---|---|---|---|---|
| 101753 | * | 6/1941 | (SE) | 220/3.3 |

* cited by examiner

*Primary Examiner*—Laura A. Callo
(74) *Attorney, Agent, or Firm*—Sand & Sebolt

(57) ABSTRACT

A double divisible connector frame for use as a support member for mounting return grilles and louvers in a building structure which is rectangular in shape and having a planar surface on one side and a pair of precisely-similar spaced-apart continuous rectangular flanged frames on the other side, and a lineal line of severance equidistant between said smaller flanged frames for dividing said double frame into a pair of similar smaller frames for mounting said grilles and louvers.

20 Claims, 4 Drawing Sheets

DOUBLE DIVISIBLE CONNECTOR FRAME FOR MOUNTING AIR GRILLES AND LOUVERS TO HEATING AND COOLING DUCT OUTLETS

This application is a continuation of application Ser. No. 09/766,061, filed Dec. 16, 1996, (status, abandoned).

This invention relates to improvements in mounting grilles and louvers in the air duct outlets of heating and cooling systems in a building structure.

In forced air heating, cooling and ventilating systems, commonly referred to as HVAC systems, the rooms of the building structure usually have one or more open end duct portions of such systems entering into such rooms. It is normal practice to mount to the outlet ends of such ducts a grille or louver facing interiorly of the rooms. Such ends may be in single, double or multiple locations, spaced together or apart, for mounting the grilles in walls or ceiling for optimum distribution and/or collection of room air. The duct outlets are frequently located between wall studs or ceiling joists and their outlet grilles or louvers must be durably connected thereto preferably in air-tight replaceable arrangement. Air leakage around the grilles will result in inefficient air delivery and circulation as well as streaking or discoloration on adjacent walls or ceiling over time. Improper or insecure mounting of the grilles to wall studs or ceiling joists, or ducts per se, by juxtaposed mounting screws often requires the grilles to be attached to the studs or joists, or ducts, at odd angles in a non-uniform and insecure manner such as when the grilles are first attached and subsequently temporarily removed for wall painting or cleaning or other purposes.

Further, the outlet ends when open after duct installation and final construction of the building frequently allow dirt and building debris to enter the ducts which dirt and debris must be removed prior to temporary or final mounting of the grilles and operation of heating and cooling systems. Connection of the grilles to the metal duct ends, studs or joists poses a problem for unskilled construction workers and is very time consuming. It is very desirable to maintain cleanliness in the ducts during final construction to eliminate duct cleaning prior to overall building cleaning, dry walling, painting, wallpapering and operation of heating and/or cooling systems. Temporary installation of the grilles containing transparent plastic film or filters has been found to be highly desirable to maintain duct cleanliness both prior to and during initial operation of heating and cooling systems. The film and/or filters are usually removed prior to system operation.

One of the objects of the present invention is to provide a new and improved connector frame for mounting air-return grilles and louvers facing inwardly into the rooms of a building structure which frame serves to securely attach the grilles to the ducts and permit their ready removal and duplicatable replacement as necessary in precise uniform alignment.

Another object of the invention is to provide a double divisible connector frame having a pair of identical single smaller flanged frames which may be used as a double connector or, when separated, singly as two smaller frames for grille mounting.

Another object of the invention is to provide a double connector frame which may be used in combination with double side-by-side duct outlets or individually, when separated, with spaced-apart duct outlets in walls or ceiling for uniform durable retention of interiorly-facing grilles and louvers.

Another object of the invention is to provide a double separable connector frame formed of durable plastic material having a pair of identical smaller flanged frames contained therewithin with a medial line of severance in the form of a lineal recess therebetween for separating the smaller frames for individual use as connectors.

Another object of the invention is to provide a double readily-separable connector frame of durable polymeric plastic material for double or single use, when separated, for retaining standardized grilles and louvers in interior rooms of a building structure at the duct outlets of heating, cooling and ventilating systems in a uniform and standardized manner wherever located.

A further object of this invention is to provide a double air-return connector frame made of polymeric material which can be used doubly or singly, and which as formed, can be readily separated into two precisely-similar connector units for uniformly mounting standardized registers, grilles and louvers interiorly of a building structure.

With the above and other objects in mind, the invention consists of a double separable connector frame for uniformly connecting air grilles and louvers to the air ducts of a building structure.

The invention consists of a rectangular separable double connector frame having a pair of similar spaced-apart smaller rectangular flanged frames contained therewithin for double or single use, when separated, for economy of manufacture and use in joining metal duct outlets to interiorly-facing uniform grilles and louvers in a uniform manner wherever located. The double frame may be readily separated along a medial line of severance into two precisely-similar flanged rectangular smaller frames having juxtaposed apertures on their shorter sides for receiving mounting screws for attachment of grilles and louvers in a uniform manner.

In the accompanying drawings the same reference numerals designate the same elements and component parts of the double and single connector frame in all views.

DETAILED DESCRIPTION OF THE PREFERRED EMBODIMENT

Figure 1:
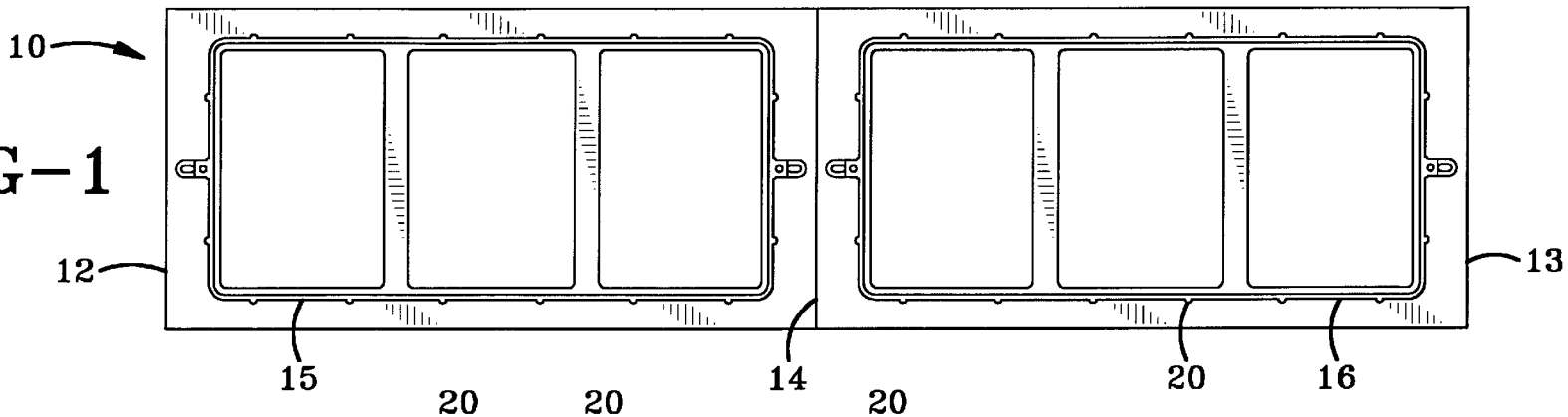
FIG. 1 is a front view of the improved rectangular double connector frame for connecting air ducts to grilles and louvers in a building structure indicating the medial line of severance for separating the double frame into two separate connectors.

FIG. 1 of the drawings illustrates a double connector frame 10 which has a rectangular shape and a much longer length dimension than the shorter width dimension. One preferred size of the frame is about 32 by 7½ inches, although the size may be varied widely. The connector frame 10 has a planar surface 11 on one side and a pair of spaced-apart precisely-similar smaller flanged frames 12 and 13 on its other side. FIG. 1 shows the two equal smaller frames 12 and 13 within the single larger frame 10. Both of the smaller frames 12 and 13 have open interior areas.

A medial line of severance 14 is shown in FIG. 1 centrally located between the two smaller frames 12 and 13. The severance line 14 comprises a small lineal recess for separation of main frame 10 into single similar frames 12 and 13 by cutting or deep scoring. Thus, frame 10 can be severed along medial line 14 into two equally dimensioned smaller flanged frames 12 and 13. Both smaller frames 12 and 13 have similar continuous peripheral flanges 15 and 16 extending around their perimeters with largely open areas therewithin.

Double frame 10 can be used to surround and be connected to a pair of side-by-side double duct outlets with no separation of its two smaller flanged frames 12 and 13. By separating the main frame 10, the two smaller frames may be used separately at spaced-apart locations to be mounted around two duct outlets. Main frame 10 has a uniform thickness of about 3/16 inch and preferably is comprised of molded polymeric material such as polypropylene.

Figure 2:
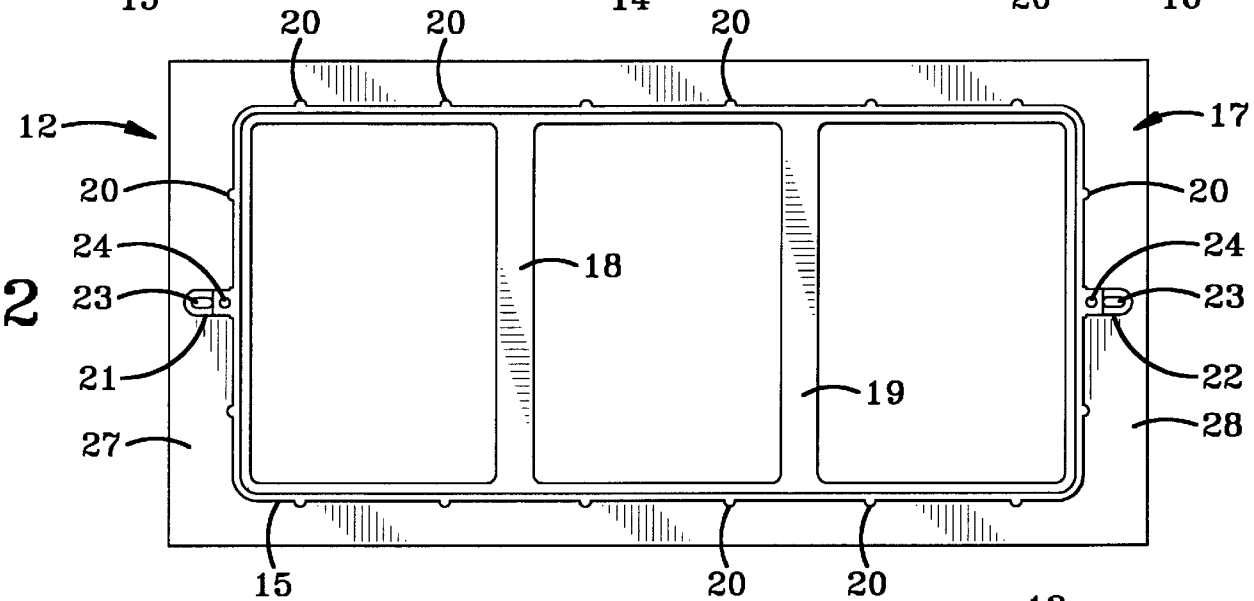
FIG. 2 is an enlarged front view of a single smaller connector frame separated from the double frame of FIG. 1.

The two smaller flanged frames 12 and 13, when separated, are precisely-similar in size and dimensions, and each has the rectangular shape shown in enlarged FIG. 2. The frame 12 is discussed herebelow, but the discussion also applies to the other frame 13 when separated. The rectangular flange 15 of frame 12 is located near its border 17 of nearly equal peripheral width. The open frame 12 has two intermediate members 18 and 19 which are extensions of its planar side, members 18 and 19 connecting the long axis sides of frame 12 for greater strength and stability. Integral members 18 and 19 of frame 12 extend through its open interior area. Members 18 and 19 have a similar thickness comparable to the border area 17 of the frame 12. The continuous flange 15 of frame 12 has a thickness of about 3/16 inch comparable to its border 17. A series of small spaced-apart ribs 20 are formed on all sides of continuous flange 15 to strengthen the flange, the ribs facing outwardly at preferably equispaced locations on opposing sides of the flange.

Figure 3:
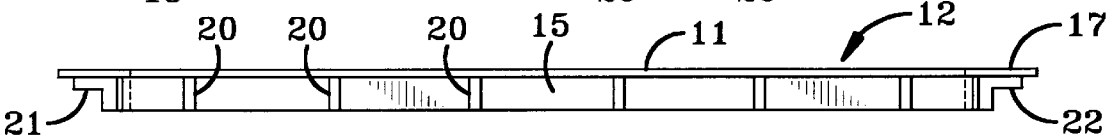
FIG. 3 is a top elevational view of the smaller flanged connector frame shown in FIG. 2.

A pair of outwardly-facing stepped projections 21 and 22 are formed medially on opposite short sides of frame 12 adjacent to and comprising a portion of flange 15. The projections 21 and 22 are formed with each step having one of two small apertures 23 and 24 to receive mounting screws to hold grilles or louvers rigidly in place when attached thereto. FIG. 2 shows the two juxtaposed stepped projections 21 and 22 centrally on the short axis sides of the frame 12 in the corners between flange 15 and the border 17 with the two small open apertures 23 and 24 on each side, one aperture on each step. FIG. 3 shows in a top plan view the frame 12 and its continuous flange 15 with the spaced strengthening ribs 20 on its upper side. This view also shows the stepped character of projections 21 and 22 formed outwardly of flange 15. The shorter step of projection 21 allows dry wall panels to be mounted against the higher step of the projection and its connector frame 12.

Figure 4:
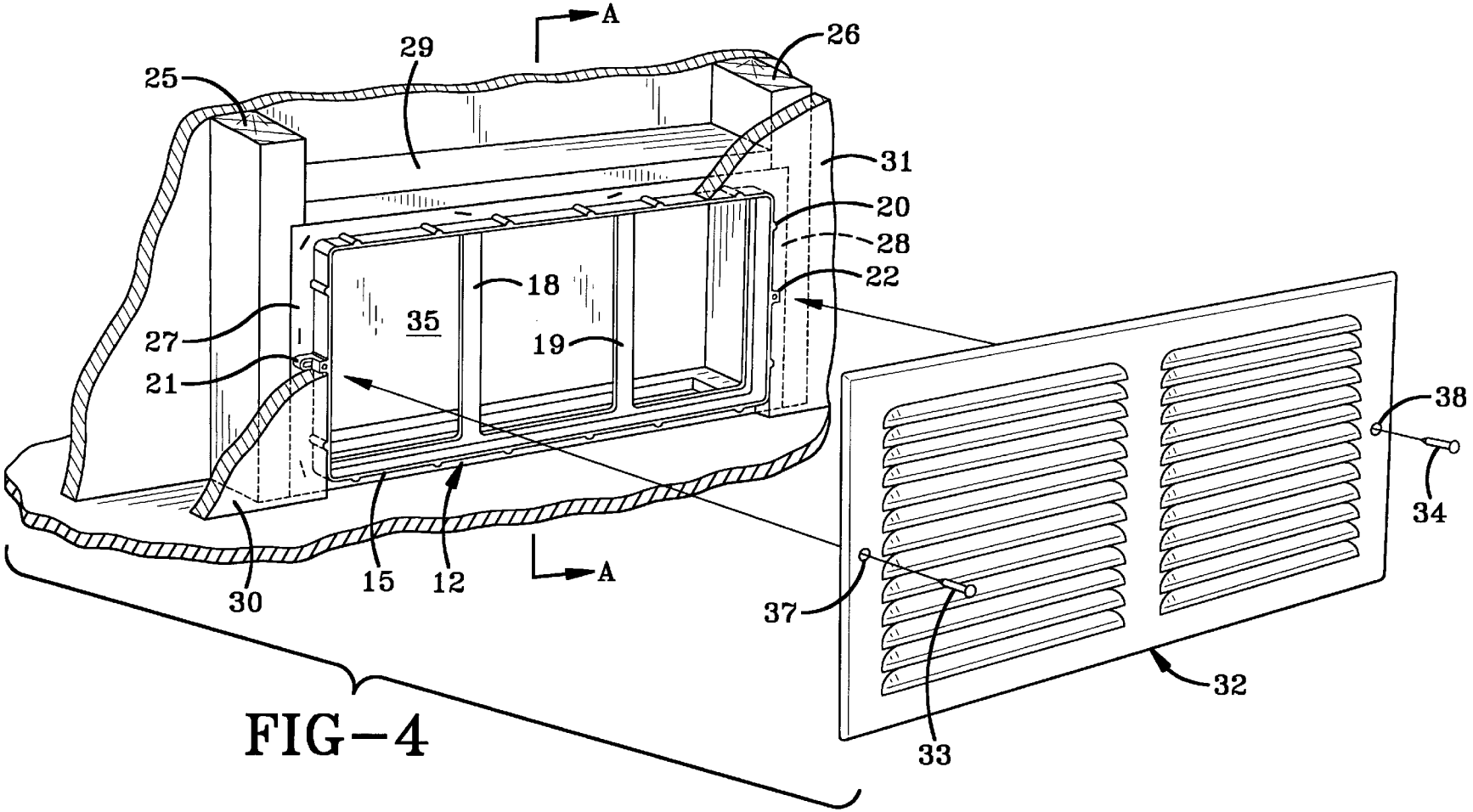
FIG. 4 is an exploded view of the single smaller flanged connector frame shown in FIGS. 2 and 3 showing the attachment of the connector frame surrounding and connected to a duct outlet with a return-air grille ready to be attached thereto.

FIG. 4 shows the subject connector frame 12 attached to spaced-apart studs 25 and 26 of a building structure. The short sides 27 and 28 of the frame border 17 are attached to the studs by stapling or nailing, for example, where the studs are normally comprised of wood. The flat face of frame 12 is directly attached to faces of parallel studs 25 and 26 and cross member 29 in the space therebetween. Cross member 29 is frequently mounted between the studs to form the duct opening 35 at the end of the duct. Dry wall members 30 and 31 are shown in FIG. 4 attached to the studs leaving the duct outlet 35 in open condition. A grille 32 is shown in FIG. 4 ready to be mounted on the connector frame 12 by a pair of threaded screws 33 and 34. The screws are connected to the open apertures in the frame projections 21 and 22 after their passage through mounting holes 37 and 38 in the grille 32. The dry wall panels 30 and 31 may be marked at locations of the lower projections for passage of screws through holes punched or drilled in the dry wall panel edges. The screws are preferably self-tapping for engagement in the opposing pair of apertures in projections 21 and 22 of the connector frame 12, depending upon the grille size.

Figure 5:
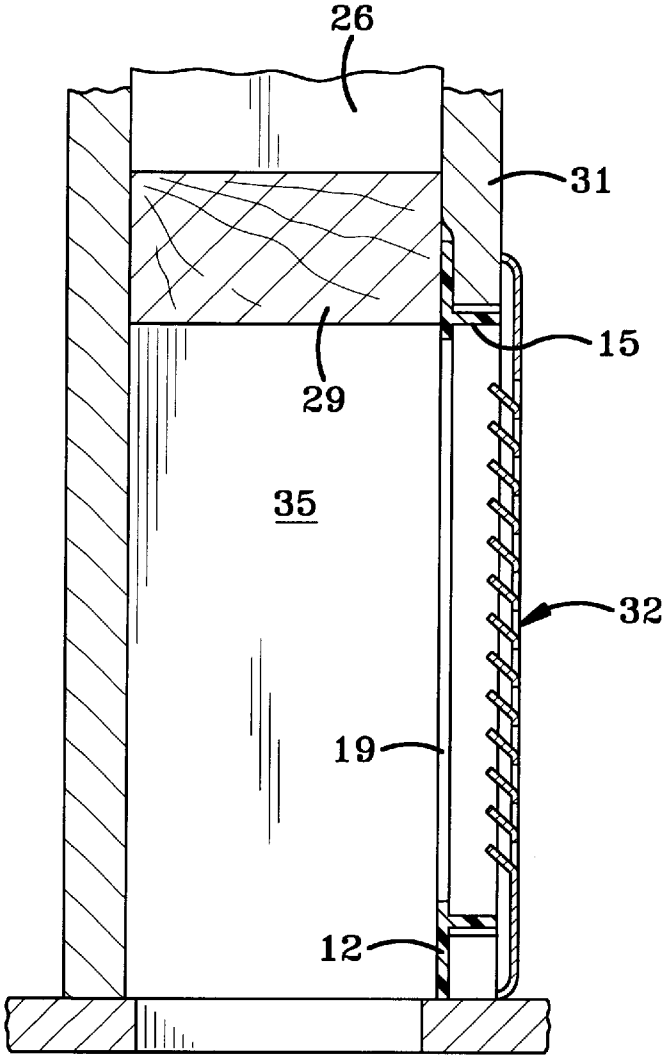
FIG. 5 is an enlarged vertical sectional view taken along the line A—A of FIG. 4 on a larger scale showing the duct outlet in a building wall, a flanged connector frame and grille mounted in place.

FIG. 5 shows in a vertical sectional view taken along line A—A of the connector frame 12 mounted on the perimeter of duct opening 35 in horizontal relation in a wall opening. The connector 12 may be similarly mounted on duct openings in ceilings as well as wall openings as desired or required. The grille 32 is directly attached to the connector frame 12 contacting the flanged edges of the frame 12.

Figure 6:
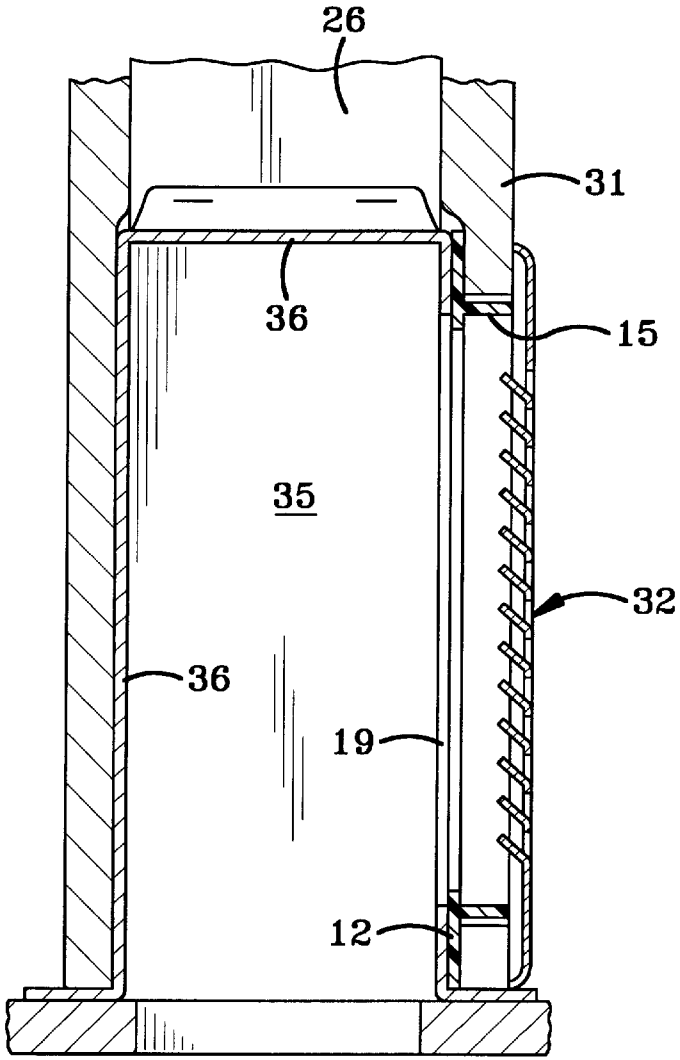
FIG. 6 is a view similar to FIG. 5 with a patented heat-resistant foil-faced ductboard material comprising the duct outlet material.

FIG. 6 is a view similar to FIG. 5 with the duct opening 35 formed of fireproof sheet duct material 36 sold under the name "Therm-O-Pan" as disclosed and claimed in U.S. Pat. No. 5,339,577 issued Aug. 23, 1994. The sheet duct material can be scored and bent into air ducts and stapled or nailed to the studs 25 and 26 to form the duct opening 35. The connector frame 12 is similarly attached to the periphery of duct opening 35 and the grille 32 attached to frame 12. Thus, the ducts can be formed of a wide variety of duct materials from sheet metal to essentially non-metallic sheet material.

Figure 7:
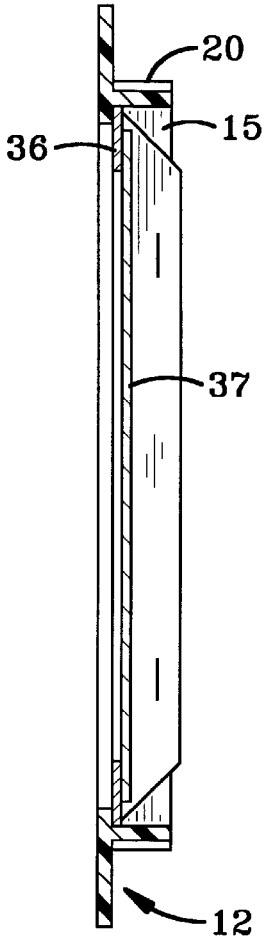
FIG. 7 is a vertical sectional view of the connector frame alone shown in FIGS. 5 and 6 having a filter member covering its open interior.

FIG. 7 shows the frame 12 alone with a continuous layer 37 of porous filtering material such as fiber glass covering the open interior area of the frame. The filter may be temporarily installed in the frame 12 for initial operation of the heating or cooling system of the building to prevent dust particles from entering the room for their collection and disposal.

Figure 8:
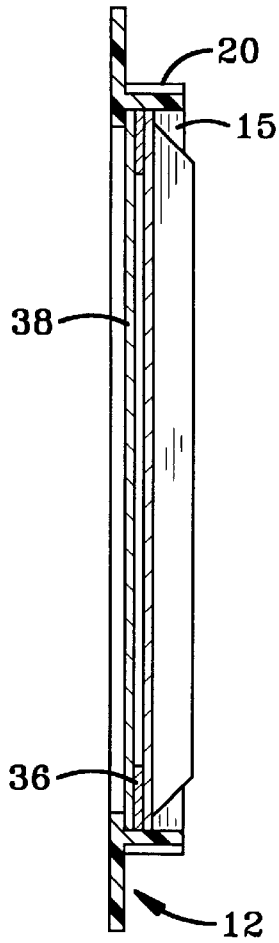
FIG. 8 is a view similar to FIG. 7 with a clear plastic film covering the interior open area of the connector frame.

FIG. 8 shows the frame 12 alone with a clear plastic film layer or sheet 38 covering the open area of the frame. The plastic film may be mounted on the flat surface 11 of the frame 12 for easy removal as desired. The transparent film sheet permits the construction workers to view the duct openings and prevent room dirt from room sources from entering the ducts during final construction. The filter or clear plastic materials are used as temporary measures to ensure duct cleanliness during latter stages of construction, such materials being mounted on frame 12 for their easy removal as desired before start-up of heating, cooling or ventilating systems. Clear or shaded or translucent plastic film, may be used on the connector frames and be peeled off prior to forced air passage.

Figure 9:
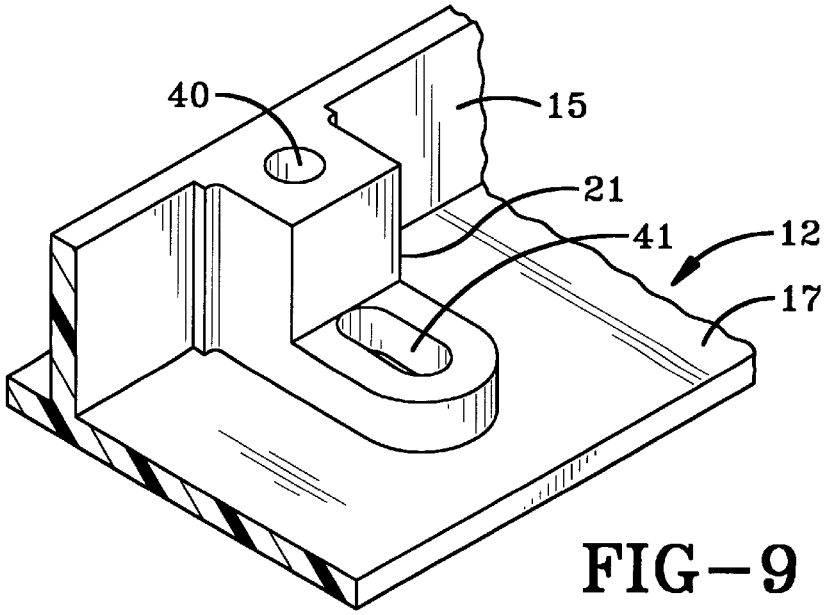
FIG. 9 is an enlarged fragmentary perspective view of the apertured projections located medially along the short axis sides of the connector.

FIG. 9 shows in an enlarged fragmentary view the projection 21 on frame 12 having the stepped contour with an aperture in each of the two steps. Aperture 40 is formed on the higher step and aperture 41 is formed on the lower step. Either of the pair of similar apertures on both sides of the frame may be used for grille attachment depending upon its standardized size.

The connector is normally mounted in level arrangement with a carpenter's level placed on its upper edge to mount the frame on the duct opening in a wall in horizontal relation. The border area 17 of the connector has a series of spaced markings molded into its sides to facilitate stapling or nailing of the connector to the wall studs. When the filter or transparent or translucent plastic film is utilized within the open area of the connector, such materials are quickly removed prior to operation of HVAC systems. The filter allows air to pass through but stops and collects dust and dirt from entering the room interior. The connector fits most commonly manufactured grilles and louvers having screw holes on their short sides in 30 by 6 and 14 by 6 inch sizes, for example. The connectors are made with safety edges and all sides and edges are so made for each of handling and installation.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention are by way of example, and the scope of the invention is not limited to the exact details shown or described.

Various modifications may be resorted to within the spirit and scope of the appended claims.

I claim:

1. In combination:

a double connector frame for use as a support member for mounting one large or two small return air grilles in a building structure;

a building structure supporting the connector frame;

a wall covering disposed over the building structure;

the wall covering defining a ventilation opening;

the connector frame including a substantially planar first surface and a second surface disposed opposite the first surface;

the first surface abutting and being secured to the building structure;

a pair of identical spaced-apart continuous rectangular projecting flanges extending from the second surface of the connector frame;

the flanges being disposed in the ventilation opening of the wall covering;

the frame defining a pair of openings, each of the flanges disposed about the perimeter of one of the openings;

each of the flanges having a length dimension and a width dimension;

the flanges being disposed in a side-by-side arrangement wherein the length dimensions are substantially parallel and the width dimensions are substantially parallel;

each flange including a pair of intermediate members extending across the opening in the frame;

a layer of porous filtering material covering each opening in the frame; and the frame including a medial line of severance disposed equidistantly between the flanges thereby allowing division of the connector frame into a pair of identical smaller frames for mounting two small grilles singly.

2. The combination of claim 1, wherein the building structure is a wall.

3. The combination of claim 1, wherein the building structure is a ceiling.

4. The combination of claim 1, wherein the building structure is a floor.

5. The combination of claim 1, wherein the wall covering is dry wall.

6. The combination of claim 1, further comprising a ventilation duct disposed adjacent the ventilation opening of the wall covering.

7. In combination:

a double connector frame for use as a support member for mounting one large or two small return air grilles in a building structure;

a building structure supporting the connector frame;

a wall covering disposed over the building structure;

the wall covering defining a ventilation opening;

the connector frame including a substantially planar first surface and a second surface disposed opposite the first surface;

the first surface abutting and being secured to the building structure;

a pair of identical spaced-apart continuous rectangular projecting flanges extending from the second surface of the connector frame;

the flanges being disposed in the ventilation opening of the wall covering;

the frame defining a pair of openings, each of the flanges disposed about the perimeter of one of the openings;

each of the flanges having a length dimension and a width dimension;

the flanges being disposed in a side-by-side arrangement wherein the length dimensions are substantially parallel and the width dimensions are substantially parallel;

each flange including a pair of stepped projections disposed centrally along the width dimension;

the stepped projection having at least one aperture adapted to receive mounting means for mounting the grille; and the frame including a medial line of severance disposed equidistantly between the flanges thereby allowing division of the connector frame into a pair of identical smaller frames for mounting two small grilles singly.

8. The combination of claim 7, wherein the building structure is a wall.

9. The combination of claim 7, wherein the building structure is a ceiling.

10. The combination of claim 7, wherein the building structure is a floor.

11. The combination of claim 7, wherein the wall covering is dry wall.

12. The combination of claim 7, further comprising a ventilation duct disposed adjacent the ventilation opening of the wall covering.

13. In combination:

a building structure;

a wall covering defining at least part of a ventilation opening;

the building structure having at least first and second spaced support elements;

each of the first and second spaced support elements having a first surface;

the wall covering disposed adjacent the first surface of the first and second support elements;

a ventilation duct having an opening disposed adjacent the ventilation opening of the wall covering;

a connector frame connected to the support elements;

the connector frame having a substantially planar body and a first flange; the body defining a first opening;

the first flange surrounding the first opening;

the body being connected to the first and second support elements;

the first flange being disposed in the ventilation opening of the wall covering and a grille connected to the connector frame;

a portion of the wall covering being disposed between the body of the connector frame and the grille.

14. The combination of claim 13, wherein the connector frame defines a second opening adjacent the first opening; the connector frame also including a second flange surrounding the second opening.

15. The combination of claim 13, wherein each flange includes a pair of stepped projections disposed centrally along the width dimension of the flange; the stepped projection having at least one aperture adapted to receive mounting means for mounting the grille.

16. The combination of claim 13, further comprising a ventilation duct connected to body of the connector frame.

17. The combination of claim 13, further comprising a removable membrane extending across the first opening of the connector frame.

18. The combination of claim 13, further comprising a removable layer of porous filtering material extending across the first opening of the connector frame.

19. The combination of claim 13, wherein the building structure is one of a wall, a floor, and a ceiling.

20. The combination of claim 13, further comprising a plurality of ribs extending between the first flange and the body.

* * * * *